US009255456B2

(12) United States Patent
Evans

(10) Patent No.: US 9,255,456 B2
(45) Date of Patent: Feb. 9, 2016

(54) METHOD AND APPARATUS FOR IMPROVING THE EFFICIENCY OF A POSITIVE DISPLACEMENT MOTOR FOR DRILLING AND OIL OR GAS WELL

(71) Applicant: Robert W. Evans, Montgomery, TX (US)

(72) Inventor: Robert W. Evans, Montgomery, TX (US)

( * ) Notice: Subject to any disclaimer, the term of this patent is extended or adjusted under 35 U.S.C. 154(b) by 335 days.

(21) Appl. No.: 13/787,951

(22) Filed: Mar. 7, 2013

(65) Prior Publication Data

US 2014/0251691 A1 Sep. 11, 2014

(51) Int. Cl.

| | |
|---|---|
| ***E21B 21/10*** | (2006.01) |
| ***E21B 34/08*** | (2006.01) |
| *E21B 34/00* | (2006.01) |

(52) U.S. Cl.

CPC ..... *E21B 21/103* (2013.01); *E21B 34/08* (2013.01); *E21B 2034/007* (2013.01)

(58) Field of Classification Search

CPC .. E21B 21/103; E21B 2034/007; E21B 34/10
See application file for complete search history.

(56) References Cited

U.S. PATENT DOCUMENTS

| | | | | |
|---|---|---|---|---|
| 4,258,801 | A | 3/1981 | Poston | |
| 4,415,027 | A * | 11/1983 | Russell | 166/113 |
| 4,537,258 | A * | 8/1985 | Beck | 166/374 |
| 4,574,894 | A | 3/1986 | Jadwin | |
| 5,873,414 | A * | 2/1999 | von Gynz-Rekowski | 166/319 |
| 6,059,038 | A * | 5/2000 | Vick, Jr. | 166/319 |
| 6,293,342 | B1 * | 9/2001 | McGarian et al. | 166/317 |
| 6,675,897 | B1 * | 1/2004 | McGarian et al. | 166/321 |
| 7,108,071 | B2 * | 9/2006 | Freiheit et al. | 166/373 |
| 2012/0073828 | A1 * | 3/2012 | Churchill | 166/373 |
| 2012/0181044 | A1 * | 7/2012 | Nikiforuk | 166/374 |
| 2012/0273055 | A1 * | 11/2012 | Lirette et al. | 137/14 |
| 2013/0269928 | A1 * | 10/2013 | Zhou | 166/113 |
| 2014/0251691 | A1 * | 9/2014 | Evans | 175/57 |
| 2014/0318806 | A1 * | 10/2014 | Machocki | 166/373 |
| 2014/0374157 | A1 * | 12/2014 | O'Neal et al. | 175/38 |

OTHER PUBLICATIONS

W. Tiraspolsky, "Hydraulic Downhole Drilling Motors: Turbodrills and Positive Displacement Rotary Motors," Nov. 1985, pp. 264-267.
Motor Operations Manual, Fourth Edition (4.3), 2005 Cavo Drilling Motors, Ltd. Co.; 4 pages.

* cited by examiner

*Primary Examiner* — Daniel P Stephenson
(74) *Attorney, Agent, or Firm* — Tumey L.L.P.

(57) ABSTRACT

A method and apparatus for improving the efficiency of a drill string that includes drilling pipe, a dump valve, a positive displacement motor and a rotary drill bit driven by the motor utilize a dump valve that does not depend upon a pressure loss to maintain the dump valve in a position which closes communication between the drilling string and the annulus between the drilling string and the well bore or casing. The dump valve includes a flow sleeve that is axially moved to close outlet passages to the annulus by the flow of fluid through the outlet passages rather than a pressure drop across the flow sleeve.

9 Claims, 2 Drawing Sheets

METHOD AND APPARATUS FOR IMPROVING THE EFFICIENCY OF A POSITIVE DISPLACEMENT MOTOR FOR DRILLING AND OIL OR GAS WELL

BACKGROUND OF INVENTION

1. Field of the Invention

This invention relates to the drilling of an oil or gas well with a subsurface positive displacement motor that is driven by drilling fluid under pressure. The positive displacement motor is connected to a drill bit at one end and a tubular drilling string at the other end.

2. Description of Related Art

When a positive displacement motor is used to drill an oil or gas well, it is known to position what is referred to as a dump valve between the drill string and the motor. The dump valve is in an open position when the drill string is being run in or out of the well. This establishes a flow path from the interior of the drill string to the annulus between the drill string and the casing or well bore which allows the drill string to either fill with drilling fluid as the drill string is run into the well or to empty as the drill string is run out of the well. When, however, drilling fluid is pumped down the drill string to the dump valve and motor, the dump valve is moved to a closed position by a pressure drop across a movable piston. This movement of the piston closes the flow path between the interior of the drill string and the annulus. See for example U.S. Pat. No. 4,574,894 to Jadwin.

Because the operation of the dump valve requires a pressure drop across a restriction in the flow path to keep it in the closed position, the efficiency of the positive displacement motor is reduced due to the pressure loss. Also at lower flow rates the valve may open altogether. See Hydraulic Downhole Drilling Motors: Turbodrills and Positive Displacement Rotary Motors by Wladimir Tiraspolsky (November 1985) pages 265-267, the contents which is expressly incorporated herein by reference thereto.

BRIEF SUMMARY OF THE INVENTION

The invention disclosed and claimed herein is for a dump valve that does not rely on a pressure loss across a sleeve to close and remain closed but rather utilizes a pressure differential between the drill pipe ID and the pressure exterior to the drill pipe or valve to move a valve sleeve to close the outlet or outlets that are in fluid communication with the annulus. In this manner the pressure loss in the fluid flow to the motor is reduced thereby increasing the efficiency of the motor.

BRIEF DESCRIPTION OF THE SEVERAL VIEWS OF THE DRAWING(S)

DETAILED DESCRIPTION OF THE INVENTION

Figure 1:
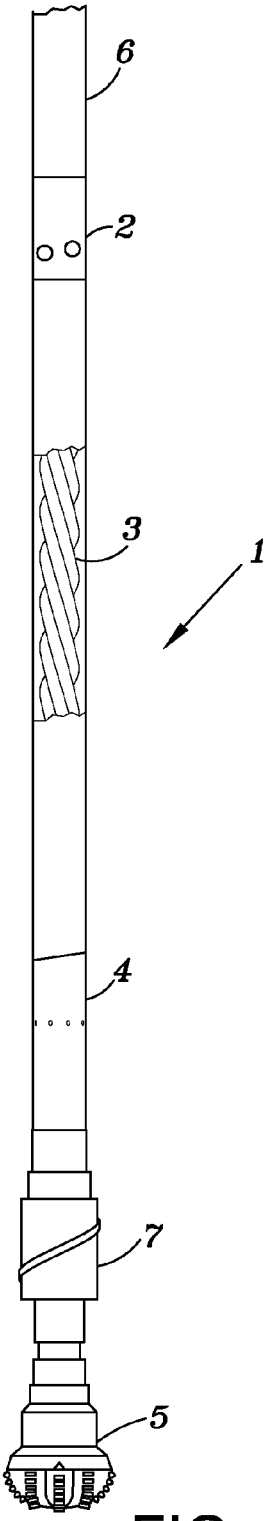
FIG. 1 is a schematic view of a drill string including a dump valve and a positive displacement motor.

FIG. 1 discloses a conventional arrangement for a drill string incorporating a positive displacement motor for drilling. The arrangement includes a dump valve 2 which is secured to a lower portion of drill pipe 6, a positive displacement motor 3, a transmission section 4, a bit stabilizer 7 and a rotary drill bit 5. The arrangement may be modified for horizontal drilling as is well known in the art.

Figure 2:
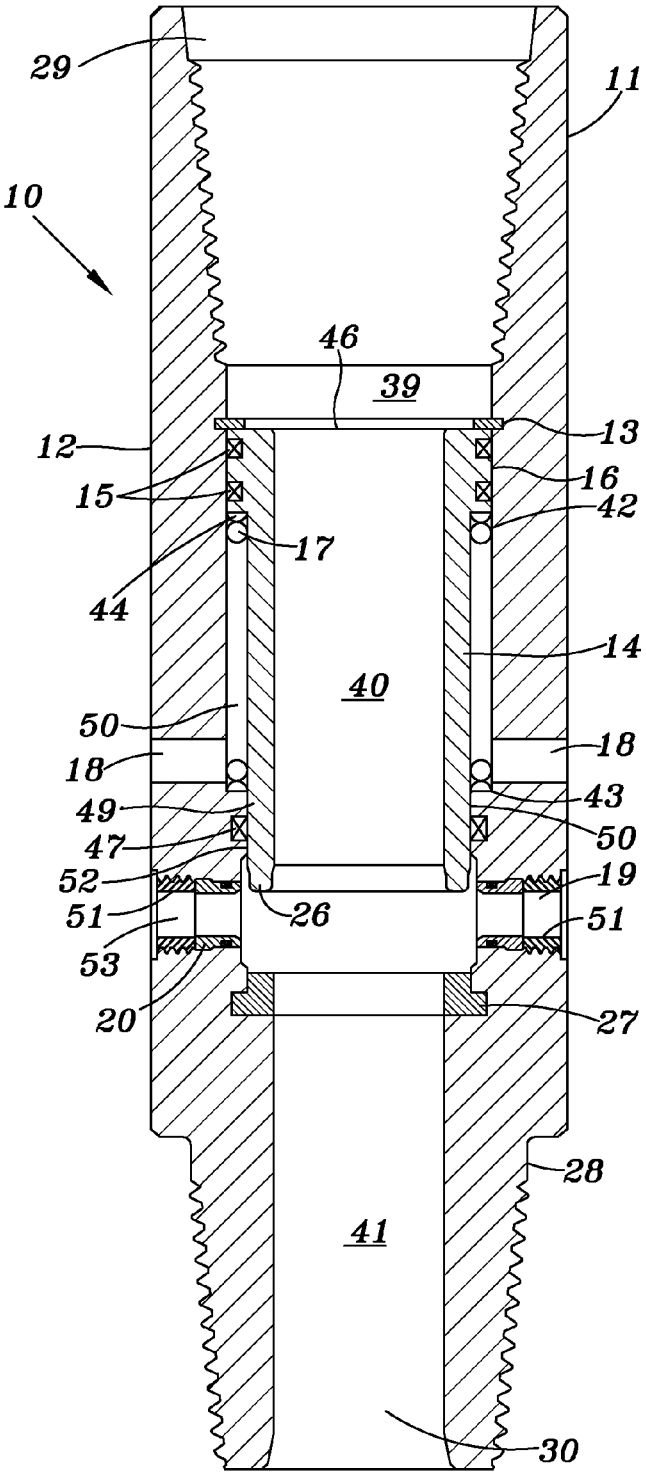
FIG. 2 is a cross-sectional view of an embodiment of a dump valve according to the invention in an open position.

FIG. 2 illustrates a novel dump valve 10 according to an embodiment of the invention. Dump valve 10 includes a main housing 12 having an upper connector 29 for connection to the drill string and a lower connector 28 for connection to a positive displacement motor. Main housing 12 includes a central bore forming flow passages 39, 40 and 41 for the drilling fluid and an intermediate chamber 42 having a first shoulder 43. Located within intermediate chamber 42 is an axially movable cylindrical flow sleeve 14 having an upper face portion 46. A lock ring 13 prevents upward movement of the flow sleeve when the valve is in the open position shown in FIG. 2. A pair of seals 15 are located in grooves around the upper portion 16 of the flow sleeve. The lower portion of the sleeve has an outside diameter smaller than the inside diameter of intermediate chamber 42 thereby forming an annular space 50 between the inner surface of the intermediate chamber and the outer surface of sleeve 14. A shoulder 44 is formed on the flow sleeve between the upper and lower portions of the flow sleeve as shown in FIG. 2. A coil spring 17 is captured between shoulder 44 on the flow sleeve and shoulder 43 of the housing.

Figure 3:
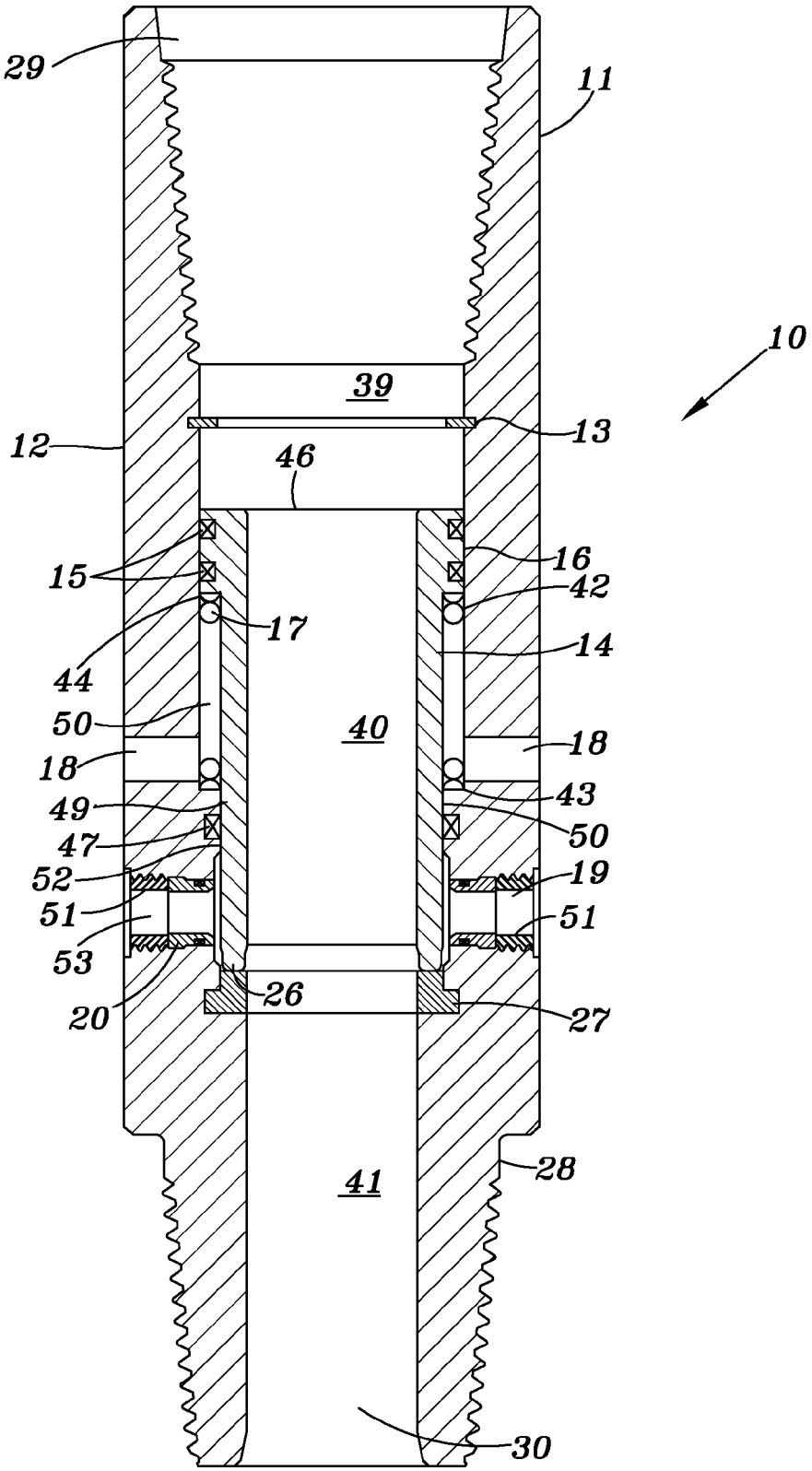
FIG. 3 is a view similar to that of FIG. 2 showing an embodiment of the invention in a closed position.

One or more radial ports 18 extend from the outer surface of housing 12 to annular space 50 thus exposing the space 50 to the pressure external of the dump valve. The bottom end 49 of the flow sleeve 14 extends closely within a thicker portion 52 of the housing in which an annular seal 47 is located. One or more radial fluid outlet passages 53 having an orifice 20, are formed in housing 12 below the lowermost section 26 of valve sleeve 14 when the valve is in the open position as shown in FIG. 2 when no drilling fluid is being pumped to the motor. Thus fluid is able to enter or exit valve housing 12 and consequently the drill string as the string is raised or lowered into the well. As drilling fluid is pumped down the drill string to the motor, pressure will increase in central bore 40 as the rate of flow through orifice 20 increases. The pressure differential between the pressure at 40 and the pressure in annular space 50, caused by the fluid flow through orifice 20 will become sufficient to overcome the force of spring 17 and the flow sleeve will move in a downwardly direction while compressing spring 17 until lower portion 26 of the flow sleeve engages a valve seat 27 as shown in FIG. 3. At this point flow passageways 53 are closed and all the drilling fluid will be directed to the positive displacement motor.

The flow passageway 40 of the flow sleeve has a substantially constant internal diameter with no constrictions which would cause a pressure drop. It also has substantially the same inner diameter of outlet passage 41. Consequently, there are no designed pressure drops that would adversely affect the efficiency of the positive displacement motor.

When drilling fluid ceases to be pumped down the drill string, compressed spring 17 will return flow sleeve 14 to the valve open position in FIG. 2 thereby opening outlet passages 53. This permits drilling fluid to exit passages 53 to the annulus between the drill string and well bore or casing. Orifice 20 of varying diameters may be secured within the outlet passageway by threaded retainers 51 that have a central bore that forms part of the outlet passages.

Although the present invention has been described with respect to specific details, it is not intended that such details should be regarded as limitations on the scope of the invention, except to the extent that they are included in the accompanying claims.

I claim:

1. A dump valve for use with a positive displacement motor in a drill string comprising:

a housing having an inlet and an outlet;

an axially movable flow sleeve positioned within the housing and forming with the housing an annular space in communication with pressure exterior to the valve;

and sealed against fluid communication with the interior of the housing in both an open and a closed position of the valve;

the flow sleeve including a flow passage therethrough;

one or more orifices formed in the housing extending between an interior portion of the housing and an exterior portion of the housing; and the flow sleeve being shiftable from a first open position to allow fluid flow through the one or more orifices to a second position blocking the flow of fluid to the one or more orifices in response to a pressure differential between the inside of the housing and an outside of the housing.

2. The dump valve according to claim 1 wherein the housing includes one or more ports axially spaced from the one or more orifices and extending from an outer surface of the housing to the annular space formed between an outer surface of the flow sleeve and an inner surface of the housing.

3. The dump valve according to claim 1 further including a spring positioned between a shoulder formed within the housing and a shoulder formed on the outer surface of the flow sleeve.

4. The dump valve according to claim 1 wherein the internal diameter of the flow sleeve is substantially equal to an internal diameter of the housing outlet.

5. The dump valve according to claim 1 further including a valve seat engaged by the flow sleeve in the closed position to cut off fluid flow to the one or more orifices.

6. A method of improving the drilling efficiency of a drill string that includes a dump valve and a positive displacement motor drivingly connected to a rotary drill bit comprising:

assembling a drill string that includes drilling pipe, a dump valve, a positive displacement motor and a rotary drill bit;

providing the dump valve with one or more orifices that extend from inside to the outside of the valve and that are normally blocked when drilling mud is pumped down to the positive displacement motor;

pumping drilling fluid into the drill string; and closing the one or more orifices in the dump valve by a pressure differential between an inside of the dump valve and an outside of the dump valve, without experiencing a pressure loss within the dump valve other than normal fluid flow friction pressure loses.

7. The method of claim 6 wherein the step of closing the one or more orifices in the dump valve without experiencing a pressure loss within the dump valve is accomplished by providing a flow sleeve having a flow path of uniform diameter that is moved from an open position to a position closing the outlet passageway(s) in response to a pressure differential between the pressure within the flow sleeve and the pressure external to the valve.

8. The dump valve according to claim 5 wherein the one or more orifices are located in the housing between one end of the flow sleeve and the valve seat when the valve is in the open position.

9. The dump valve according to claim 1 wherein the flow passage of the flow sleeve has a uniform diameter.

* * * * *